US005408958A

United States Patent [19]

Esch et al.

[11] Patent Number: 5,408,958

[45] Date of Patent: Apr. 25, 1995

[54] CYLINDER HEAD FOR AN INTERNAL-COMBUSTION ENGINE

[75] Inventors: Hans-Joachim Esch, Heimsheim; Willi Schultz, Neulingen, both of Germany

[73] Assignee: Dr. Ing. h.c.F. Porsche AG, Germany

[21] Appl. No.: 208,118

[22] Filed: Mar. 9, 1994

[30] Foreign Application Priority Data

Mar. 9, 1993 [DE] Germany ..... 43 07 368.9

[51] Int. Cl.[6] ..... F01L 1/26; F01L 1/00; F02D 13/00; F02F 1/42

[52] U.S. Cl. ..... 123/90.15; 123/90.27; 123/308

[58] Field of Search ..... 123/90.15, 90.16, 90.17, 123/90.22, 90.27, 90.39, 90.48, 470, 308, 432, 90.44

[56] References Cited

U.S. PATENT DOCUMENTS

| | | | |
|---|---|---|---|
| 4,285,310 | 8/1981 | Takizawa et al. | 123/90.16 |
| 4,617,881 | 10/1986 | Aoi et al. | 123/90.27 |
| 4,637,356 | 1/1987 | Kuroda | 123/90.27 |
| 4,667,636 | 5/1987 | Oishi et al. | 123/90.16 |
| 4,779,589 | 10/1988 | Matsuura et al. | 123/90.15 |
| 4,799,463 | 1/1989 | Konno | 123/90.16 |
| 4,889,084 | 12/1989 | Rembold | 123/90.16 |
| 4,955,347 | 9/1990 | Toyoda | 123/470 |
| 5,235,940 | 8/1993 | Nakatani | 123/90.16 |
| 5,269,270 | 12/1993 | Suzuki et al. | 123/90.16 |

FOREIGN PATENT DOCUMENTS

| | | |
|---|---|---|
| 0213758 | 3/1987 | European Pat. Off. . |
| 0340834 | 11/1989 | European Pat. Off. . |
| 0433728 | 6/1991 | European Pat. Off. . |
| 2512493 | 3/1983 | France . |
| 3600408 | 5/1992 | Germany . |

*Primary Examiner*—Andrew M. Dolinar
*Assistant Examiner*—Weilun Lo
*Attorney, Agent, or Firm*—Evenson, McKeown, Edwards & Lenahan

[57] ABSTRACT

A cylinder head of an internal-combustion engine has three intake valves on one side of a longitudinal center plane and has two exhaust valves on the other side. The intake valves are arranged in a circumferential direction of a cylinder of the internal-combustion engine, and a first intake valve arranged close to the edge of a combustion chamber is permanently driven by a camshaft by means of a space-saving actuating lever. The other intake valves are connected successively or isochronously according to the requirements. When the load is low, a fuel-saying load movement is achieved by the tangential inflow through the first intake valve, while, when the load requirements are higher, an optimized mixture flow rate is possible via the connected valves.

16 Claims, 5 Drawing Sheets

CYLINDER HEAD FOR AN INTERNAL-COMBUSTION ENGINE

BACKGROUND AND SUMMARY OF THE INVENTION

This invention relates to a cylinder head for an internal-combustion engine of the type having a plurality of charge cycle valves, arranged at respective sides of a longitudinal center plane of the cylinder head.

U.S. Pat. No. 4,637,356 discloses a valve gear comprising three intake valves actuated by a camshaft, the center valve of these intake valves being actuated in line by means of a rocker lever and the two exterior valves being actuated directly by way of bucket tappets.

From German Patent Document DE-36 00 408 C2, a cylinder head is known which has three intake valves and in the case of which a separate intake pipe provided with a throttle valve and an injection valve is assigned to each intake port. For generating a swirl movement of the charge, only a single exterior intake valve is actuated in a first operating range. As the rotational speed increases, the throttle valves and injection valves of the second and third intake valve are actuated successively.

It is an object of the invention to provide a cylinder head for an internal-combustion engine with improved power and torque values.

This object is achieved by means of a cylinder head for an internal-combustion engine comprising a first group of charge cycle valves arranged on one side of a cylinder head longitudinal center plane, said first group of charge cycle valves being spaced from one another along a circumferential direction about a central axis of an engine cylinder when the cylinder head is in an operative position on an engine, a first camshaft for actuating the first group of charge valves, and an operating lever operatively connected to the first camshaft for continuously acting on one charge valve of the first group, said remaining charge valves of the first group being selectively actuated by the first camshaft.

If, in the case of a cylinder head of the above-mentioned type, a charge cycle valve, which is first in the circumferential direction of each cylinder and is arranged in line with an actuating lever, is actuated permanently and the other valves of this group are actuated at times, this cylinder head is optimized with respect to the charge cycle and furnishes an increased power and torque yield.

Because of the absence of a space-consuming bucket tappet, the permanently operated valve permits a space-saving arrangement at the edge of a combustion chamber. The resulting tangential inflow causes a targeted rotating charge movement ("swirl"). The radial arrangement of this valve makes it possible to design the valve or the additional valves of the first group to be comparatively large and to therefore achieve an optimal mixture flow rate for high performances. Since this increased mixture flow rate is required only at high loads, the additional valves can be connected or disconnected by means of switching mechanisms.

These mechanisms may be designed in multiple manners; thus, for example, as a switching arrangement according to German Patent Document DE-40 27 630 C integrated into a hydraulic tappet or as devices according to German Patent Document DE-41 00 763 A which couple and uncouple the corresponding cams to and from the camshaft, and are therefore not discussed in detail.

For a further optimization, a first separate intake pipe is assigned to the permanently operated charge cycle valve which is constructed as an intake valve, and another intake pipe is assigned to the additional valves of this group. With respect to their geometry, the intake pipes can therefore be adapted to the different requirements of a low-load or a high-load operation.

If the cylinder head is operated on a spark-ignited internal-combustion engine, corresponding arrangements for the supply of fuel are assigned to these intake pipes, and a shaft which is arranged centrally in the cylinder head above each cylinder is used for receiving the spark plug.

On a spontaneous-ignition internal-combustion engine, this shaft instead houses the arrangement for the supply of fuel.

If the first group of charge cycle valves has, for example, three intake valves, the internal-combustion engine can be operated in a fuel-saving manner at low loads by means of only one first intake valve which has a comparatively small diameter. An exhaust valve of the second group may be equipped with a switching mechanism in the same manner. The internal-combustion engine may then be operated as a two-valve engine, in which case only a low driving power is required for the valve gear.

In the case of increasing loads, the two additional intake valves and the second exhaust valve will then be connected isochronously or successively. The mixture flow will then take place essentially by way of the additional valves which are dimensioned to be comparatively large so that the internal-combustion engine may then be considered to be a power-optimized 4-valve engine.

In a further advantageous development, the angular positions of the longitudinal center axes of the charge cycle valves are selected such that a combustion chamber roof is obtained which is as smooth as possible and has no fissures. As a result, a knocking combustion is largely avoided, and the knock limit is displaced in the direction of a higher power yield.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
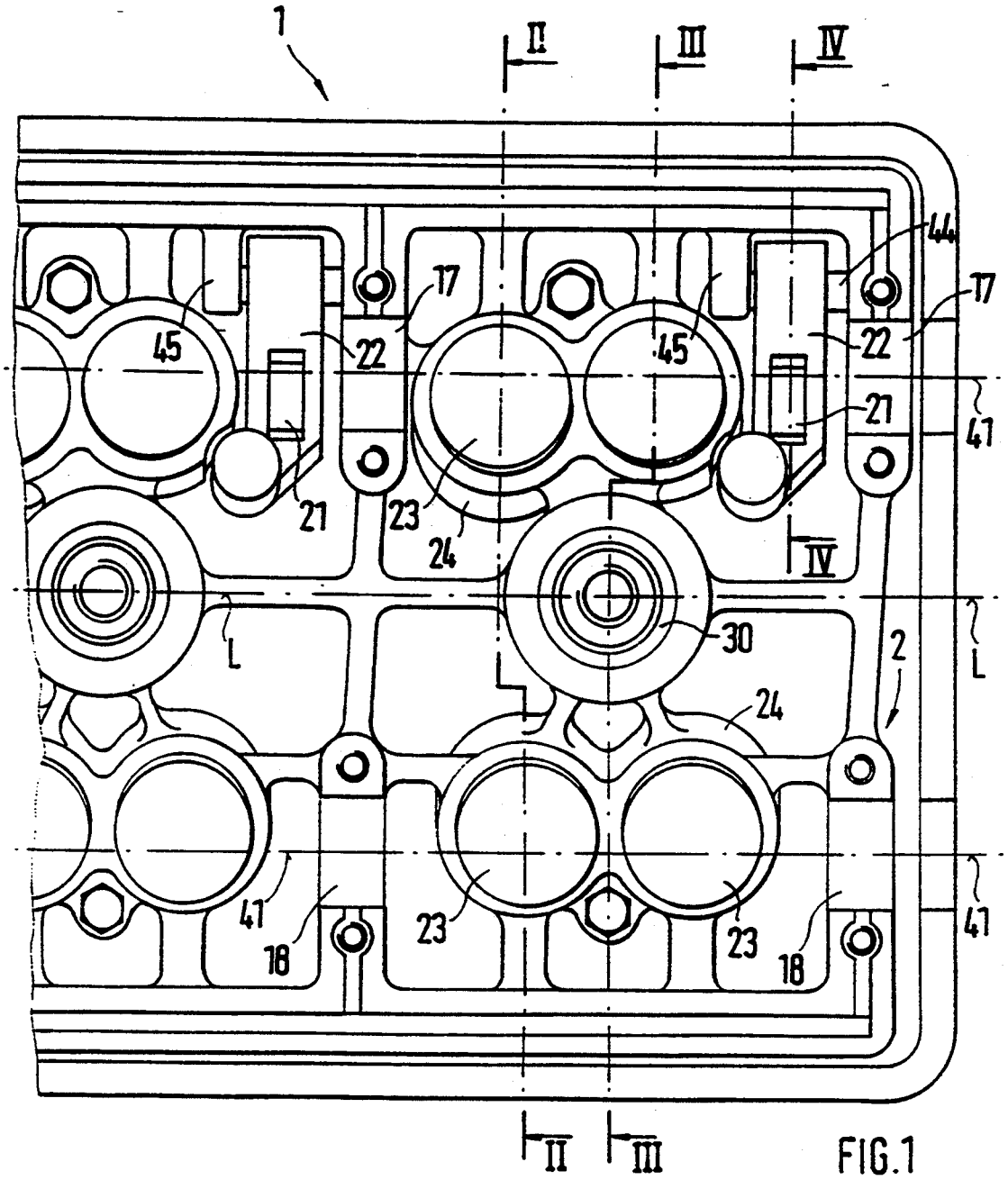
FIG. 1 is a top view of a cylinder head of an internal-combustion engine.
Figure 2:
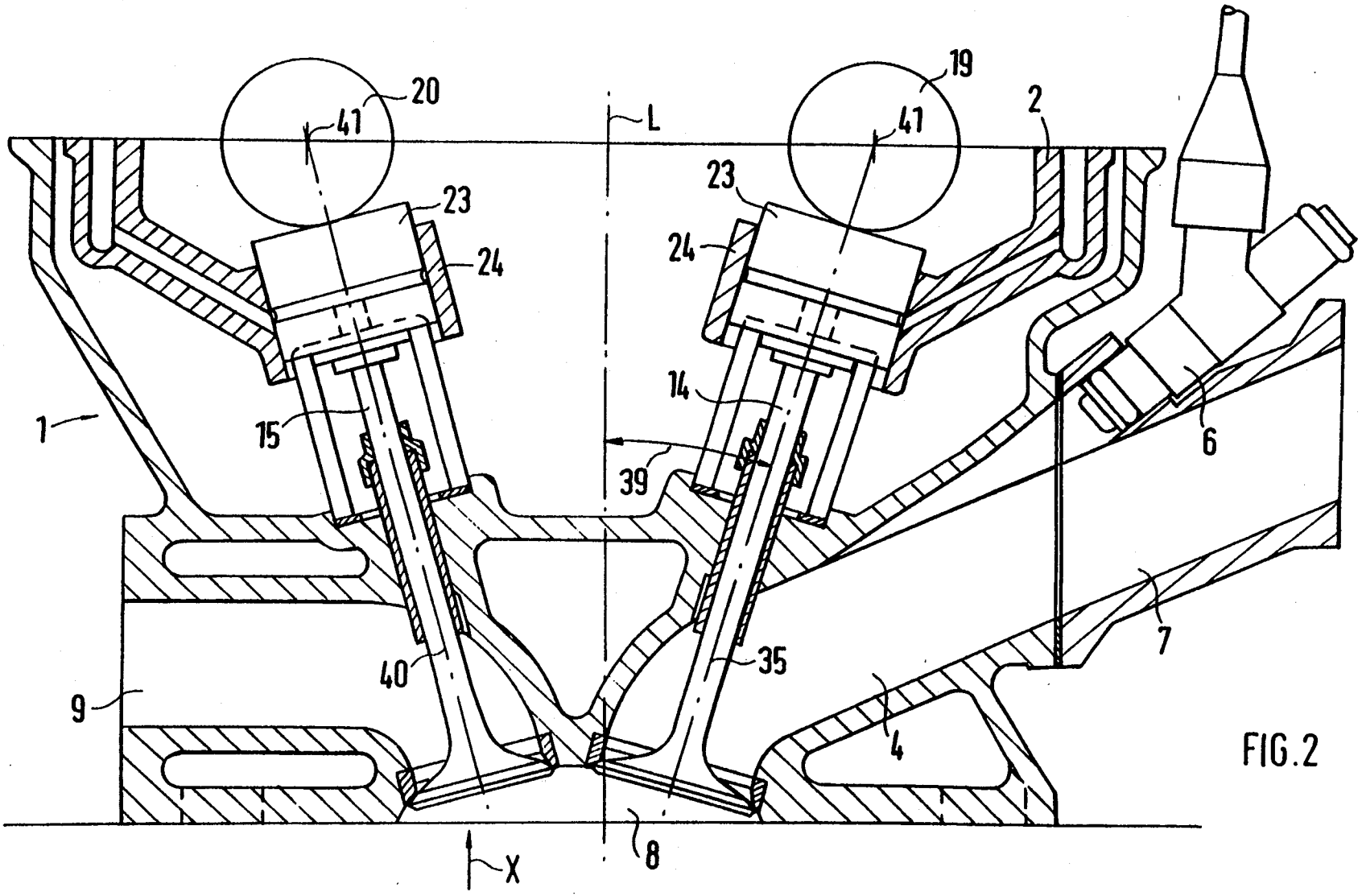
FIG. 2 is a sectional view along Line II—II according to FIG. 1.
Figure 3:
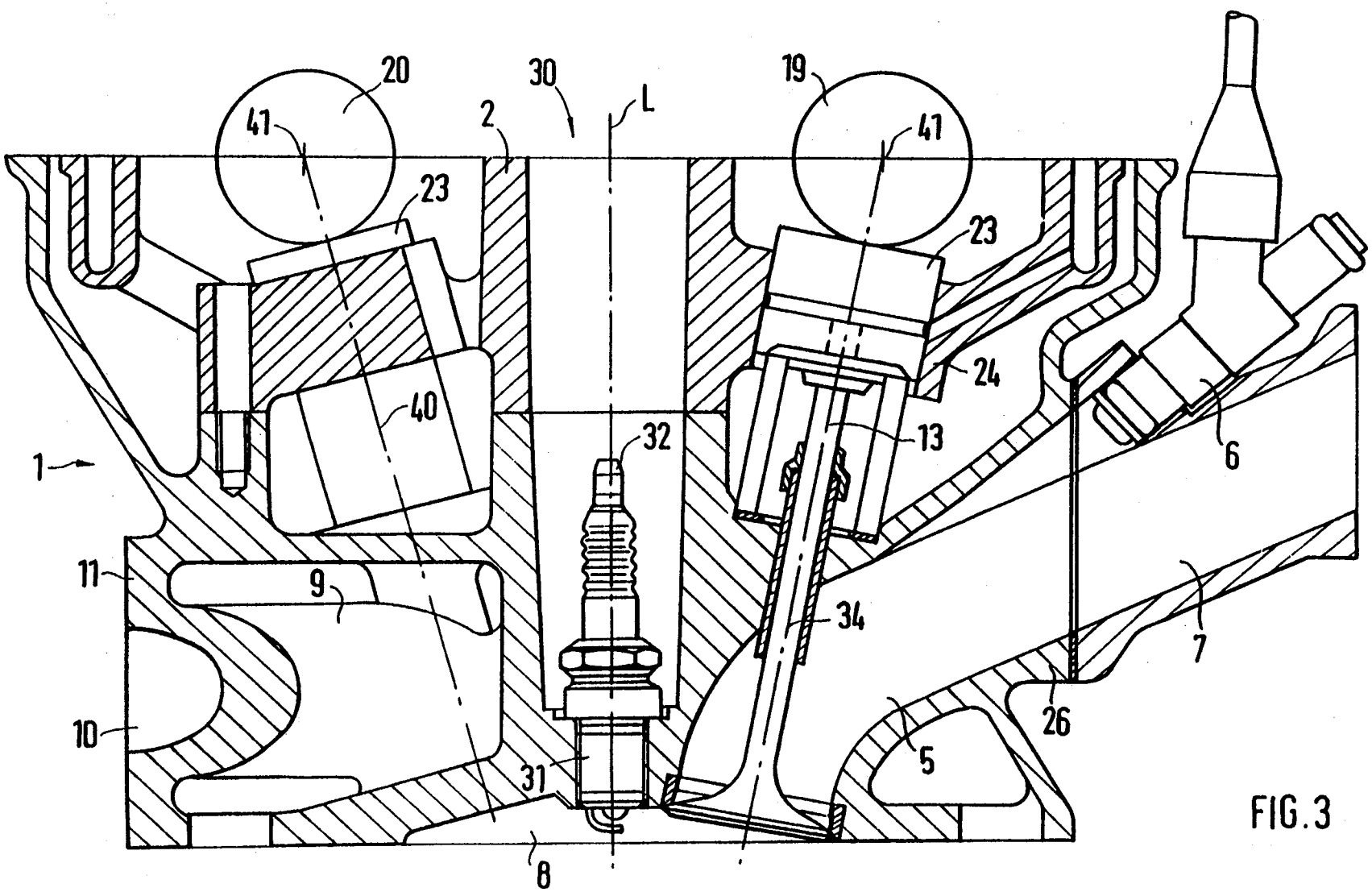
FIG. 3 is a sectional view along Line III—III according to FIG. 1.
Figure 4:
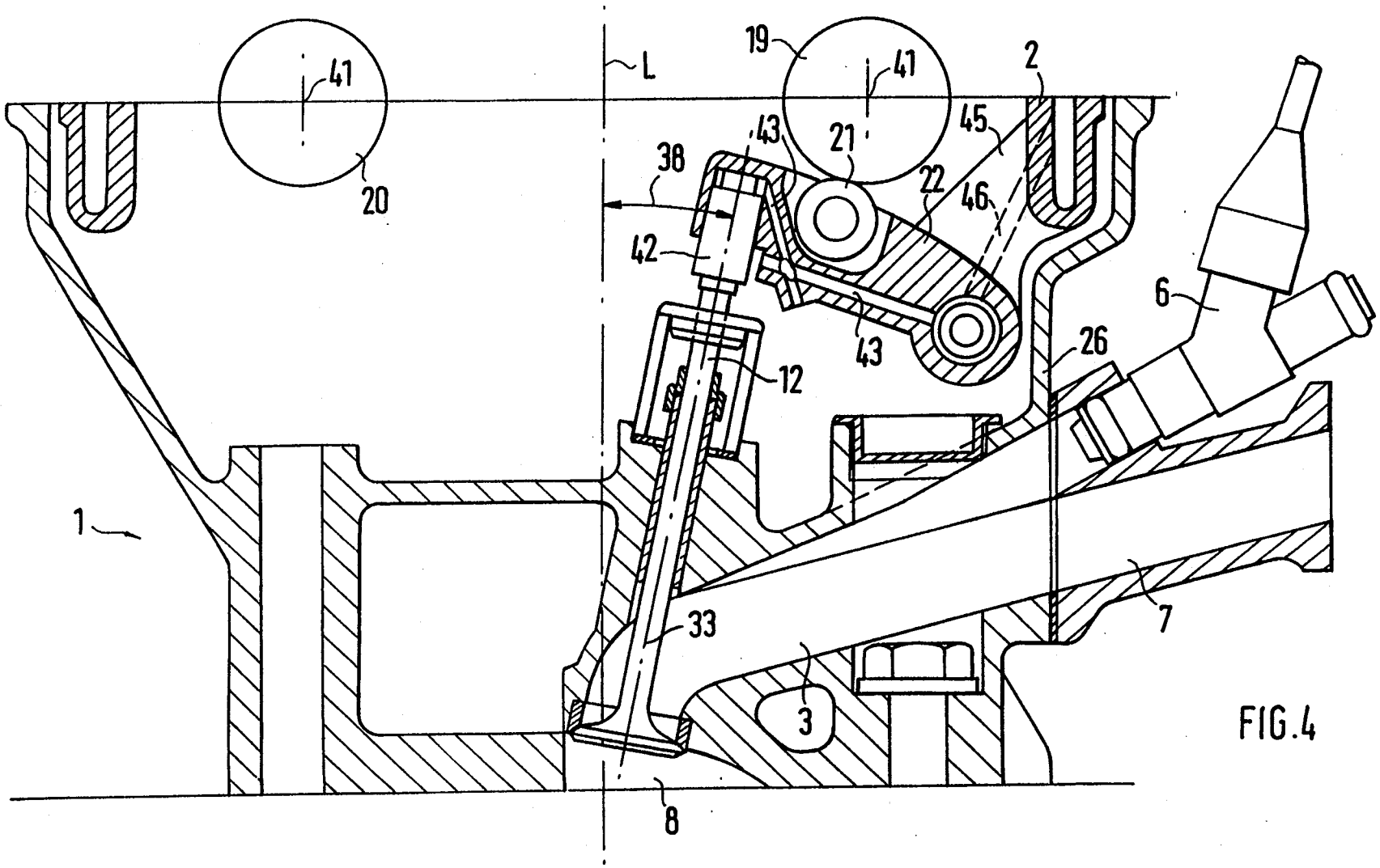
FIG. 4 is a sectional view along Line IV—IV according to FIG. 1.
Figure 5:
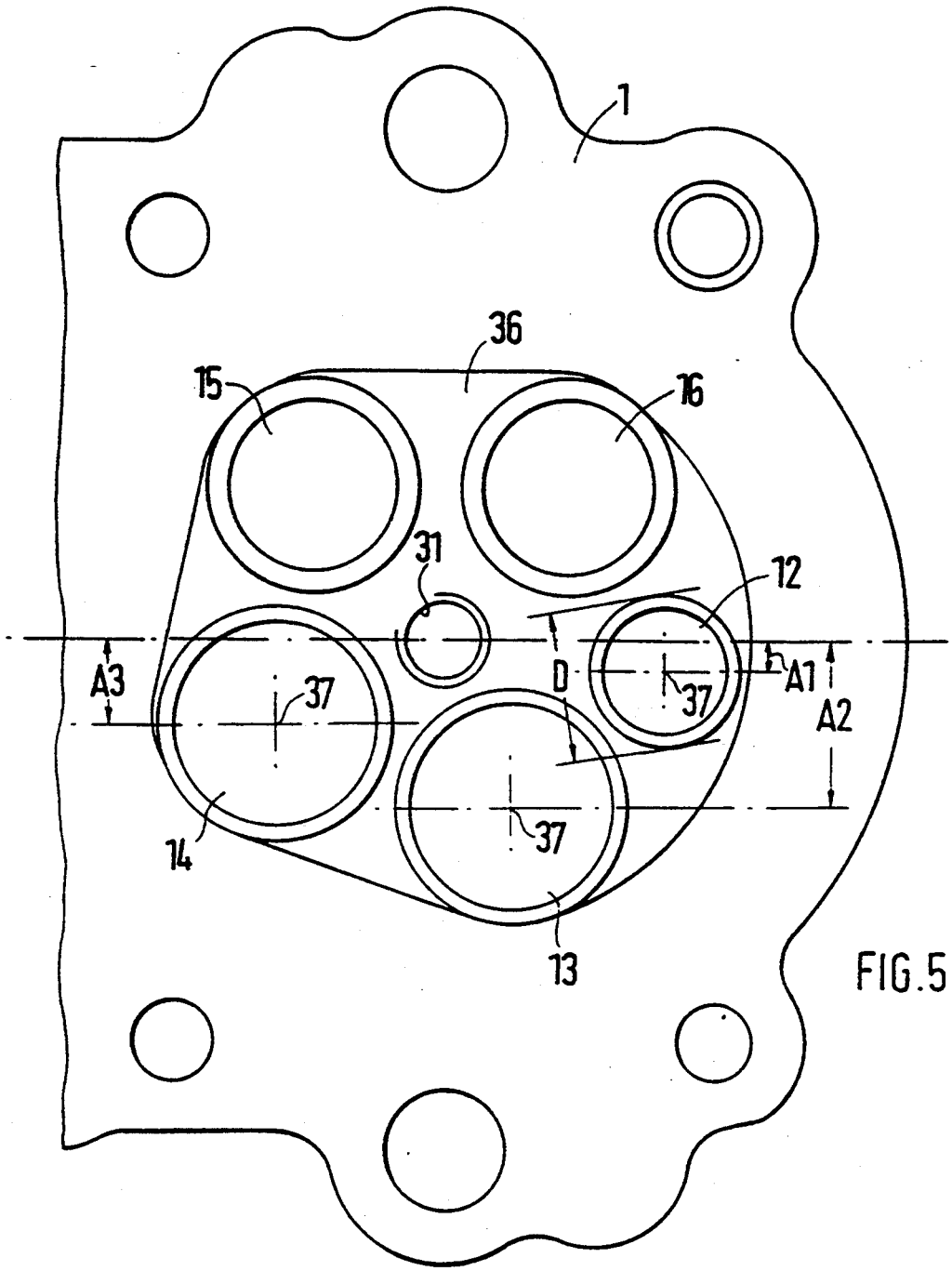
FIG. 5 is a view from the direction of arrow X according to FIG. 2.

A multi-cylinder internal-combustion engine has a cylinder head 1 which is equipped with charge cycle ports and an inserted bearing frame 2. On one side of a longitudinal center plane L of the cylinder head 1, the ports are constructed as intake ports 3, 4, 5 which extend, starting out from pipe sockets provided with injection valves 6 and constructed as intake pipes 7, to a combustion chamber 8.

On the other side of the plane L, exhaust ports 9, 10 extend to a wall 11 of the cylinder head 1 which start out from the combustion chamber 8.

The intake and exhaust valves 3, 4, 5 and 9, 10 are dominated by a first and second group of charge cycle valves which are constructed as intake and exhaust valves 12, 13, 14 and 15, 16. The intake valves 12, 13 and 14 are arranged along a circumferential direction of each cylinder.

The bearing frame 2 has bearings 17, 18 for only schematically illustrated camshafts, in which case a first camshaft, which is constructed as an inlet camshaft 19, is disposed in first bearings 17, and a corresponding outlet camshaft 20 is disposed in the second bearings 18. By means of an actuating lever which is constructed as a rocker lever 22 and is provided with a roller 21, the first intake valve 12 is moved by the intake camshaft 19 which opens and closes the second and third intake valve 13, 14 by means of bucket tappets 23. In this case, the bucket tappets 23 are disposed in a slidably displaceable manner in receiving devices 24 of the bearing frame 2. The two exhaust valves 15 and 16 are also actuated directly by the outlet camshaft 20 by means of bucket tappets 23.

The first intake valve 12 is permanently actuated in all operating points of the internal-combustion engine and ensures a tangential inflow into the combustion chamber 8, whereby a targeted charge movement is achieved.

The additional intake valves 13, 14 and one exhaust valve 16 can be optionally coupled to the camshafts 19, 20 by means of hydraulic switching mechanisms which are not shown and which are integrated in the bucket tappets 23.

When the load of the internal-combustion engine is low, the intake valves 13, 14 and the second exhaust valve 16 are inoperative. As the load increases, the valves which were switched off at first are then successively connected.

All charge cycle valves are constructed as disk valves, in which case the diameter D of the first intake valve 12 is smaller than that of the other valves.

The intake port 3, which is assigned to the first intake valve 12, is connected with a first intake pipe 7 which has an injection valve 6. The additional intake ports 4 and 5 are jointly connected to a second intake pipe 7 which also has an injection valve 6. In this case, the intake pipes 7 are detachably held on an exterior wall 26 of the cylinder head 1.

Centrally in the cylinder head 1 or the bearing frame 2, a shaft 30 is constructed above each cylinder which leads by means of an opening 31 into the combustion chamber 8 and is intersected by the longitudinal center plane L. A spark plug 32 is inserted into this opening 31 as an ignition device.

All charge cycle valves move along their longitudinal center axes, in which case the intake valves 12, 13, 14 are arranged such that their longitudinal center axes 33, 34, 35 intersect with a combustion chamber roof 36 in such a manner that the resulting points of intersection 37 have a respectively different distance A1, A2 and A3 from the longitudinal center plane L.

The longitudinal center axes 33 and 34 of the first and second intake valve 12 and 13 extend in parallel to one another, the longitudinal center axis 33 enclosing an angle 38 with the longitudinal center plane L, which is smaller than the corresponding angle 39 of the longitudinal center axis 35 of the third intake valve 14.

Longitudinal center axes 40 assigned to the exhaust valves 14 and 16 as well as those of the intake valves 13 and 14 each intersect longitudinal axes 41 of the camshafts 19, 20.

The rocker lever 22 has a hydraulic valve clearance compensating element 42 which is supplied with pressure oil via bores 43. This lever 22 is rotatably disposed on a shaft 44 which is held on one side in a bearing arm 45 of the frame 2. A feeding bore 46 for the feeding of the compensating element 42 and for the lubrication of the rocker lever 22 extends in this arm 45.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A cylinder head for an internal-combustion engine comprising:

a first group of charge cycle valves arranged on one side of a cylinder head longitudinal center plane;

said first group of charge cycle valves being spaced from one another along a circumferential direction about a central axis of an engine cylinder when the cylinder head is in an operative position on an engine;

a first camshaft for actuating the first group of charge valves;

an operating lever operatively connected to the first camshaft for continuously acting on one charge valve of the first group, remaining charge valves of the first group being selectively actuated by the first camshaft;

wherein said one charge valve continuously acted on by the operating lever is first in said circumferential direction;

a second group of charge cycle valves arranged on an opposite side of the longitudinal center plane with respect to the first group;

a second camshaft for actuating the second group of charge valves; and wherein all other charge cycle valves are actuated by the camshafts by means of bucket tappets.

2. A cylinder head according to claim 1, wherein each charge cycle valve of the first group is arranged in a separate charge cycle port of the cylinder head, and wherein two pipe sockets are arranged on an exterior wall of the cylinder head which are assigned to the ports, a first pipe socket being connected exclusively with a charge cycle port of the first charge cycle valve.

3. A cylinder head according to claim 1, wherein the first group of intake valves is formed whose charge cycle ports are constructed as intake ports the first intake port having the first intake valve being connected with a pipe socket constructed as the first intake pipe.

4. A cylinder head according to claim 3, wherein the first group comprises a second and third intake valve and whose second and third intake port is connected with a pipe socket constructed as the second intake pipe.

5. A cylinder head according to claim 3, wherein an opening is arranged adjacent to the intake ports, which lead into a combustion chamber, and which connects this combustion chamber with a shaft opening which is arranged centrally in the cylinder head and is cut by the longitudinal center plane.

6. A cylinder head according to claim 5, wherein an ignition device is inserted into the shaft opening and the intake pipes are provided with a device for the supply of fuel.

7. A cylinder head according to claim 5, wherein a device for the supply of fuel is inserted in the opening.

8. A cylinder head according to claim 1, wherein the remaining valves of the first group are operatively connected and disconnected isochronously with the first camshaft.

9. A cylinder head according to claim 1, wherein the remaining valves of the first group are operatively connected and disconnected with the first camshaft so that they are mutually staggered with respect to time.

10. A cylinder head according to claim 8, wherein at least one charge cycle valve of the second group constructed as a first exhaust valve is permanently actuated by the second camshaft.

11. A cylinder head according to claim 9, wherein at least one charge cycle valve of the second group constructed as a first exhaust valve is permanently actuated by the second camshaft.

12. A cylinder head according to claim 1, wherein all charge cycle valves are constructed as disk valves, the diameter of the disk of the first valve being smaller than that of the remaining valves of this group.

13. A cylinder head according to claim 1, wherein the longitudinal center axes of the valves of the first group intersect a combustion chamber roof in such a manner that the resulting points of intersection are all situated on one side of the longitudinal center plane and have a mutually different distance from this plane.

14. A cylinder head according to claim 13, wherein the longitudinal center axes of the first charge cycle valve and of a valve of this group which is adjacent in the circumferential direction are arranged to be extending in parallel to one another.

15. A cylinder head according to claim 14, wherein the longitudinal center axis of the first charge cycle valve encloses an angle with the longitudinal center plane which is smaller than the corresponding angle of the longitudinal center axis of a valve of this group spaced away in the circumferential direction.

16. A cylinder head according to claim 1, wherein said one charge valve provides a tangential inflow into a combustion chamber, whereby a target charge movement is achieved.

* * * * *